United States Patent [19]

Dapperheld et al.

[11] Patent Number: 4,950,367

[45] Date of Patent: Aug. 21, 1990

[54] PROCESS FOR THE PREPARATION OF FLUOROMALONIC ACID AND ITS DERIVATIVES

[75] Inventors: Steffen Dapperheld, Kriftel; Rudolf Heumüller, Rodgau, both of Fed. Rep. of Germany

[73] Assignee: Hoechst Aktiengesellschaft, Frankfurt am Main, Fed. Rep. of Germany

[21] Appl. No.: 302,440

[22] Filed: Jan. 26, 1989

[30] Foreign Application Priority Data

Jan. 30, 1988 [DE] Fed. Rep. of Germany ..... 3802745

[51] Int. Cl.[5] ..... C25C 3/00

[52] U.S. Cl. ..... 204/59 R; 204/59 F; 204/72; 204/73 R

[58] Field of Search ..... 204/72, 73 R, 59 R, 204/59 F

[56] References Cited

U.S. PATENT DOCUMENTS

| | | | |
|---|---|---|---|
| 4,162,948 | 7/1979 | Yagii et al. | 204/72 |
| 4,533,454 | 8/1985 | Kyriacou et al. | 204/73 R |
| 4,588,484 | 5/1986 | Justice et al. | 204/73 R |
| 4,707,226 | 11/1987 | Dapperheld | 204/73 R |
| 4,800,012 | 1/1988 | Dapperheld et al. | 204/73 R |

FOREIGN PATENT DOCUMENTS

| | | |
|---|---|---|
| 59-046256 | 3/1984 | Japan . |
| 185878 | 9/1966 | U.S.S.R. . |

OTHER PUBLICATIONS

E. D. Bergmann et al, J. Chem. Soc., [1959], pp. 3286–3289.

Yu I. Bogodist et al, Chem. Abs. 67:2777r (1967).

H. Gershon et al, J. Org. Chem., 31, 916–918 (1966).

N. Ishikawa et al, Chemistry Letters (Chem. Soc. Japan), 1981, pp. 107–110.

*Primary Examiner*—John F. Niebling

*Assistant Examiner*—Steven P. Marquis

[57] ABSTRACT

A process for the preparation of fluoromalonic acid and derivatives thereof having the formula

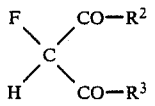

(II)

wherein $R^2$ and $R^3$ are equal or different and represent hydroxyl, the group OX, wherein X represents an alkali metal, alkaline earth metal or $NH_4^+$ ion or a $C_1$–$C_{12}$-alkyl group, or represent the group $NR^4R^5$, wherein $R^4$ and $R^5$ are equal or different and are hydrogen or a hydrocarbon group of 1 to 12 carbon atoms, which comprises subjecting a compound of the formula

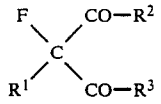

(I)

wherein $R^1$ is halogen of an atomic weight in the range from 35 to 127 and $R^2$ and $R^3$ have the meaning indicated above, to an electrolysis in an electrolyte liquid consisting of water, an organic solvent or a mixture thereof, at a temperature in the range of from −20° C. to the boiling temperature of the electrolyte, at a current density in the range of from 1 to 600 mA/cm$^2$ at a cathode consisting of lead, cadmium, zinc, copper, tin, zirconium, mercury, alloys of at least 2 of these metals or of carbon.

23 Claims, No Drawings

PROCESS FOR THE PREPARATION OF FLUOROMALONIC ACID AND ITS DERIVATIVES

Biologically active organic fluorine compounds are frequently used as plant protection agents or pharmaceuticals. In many cases, such compounds have high efficacy, frequently coupled with a lower level of side effects, effects attributable to the fluorine substitution, such as higher lipid solubility and higher stability to oxidation, playing an important role.

A number of preparative methods for the direct introduction of a fluorine atom into the desired position of organic molecules are known today. However, since direct fluorination is frequently not feasible, the preparation of fluorinated intermediates for the synthesis of the compounds under consideration is particularly important. Thus, fluoromalonic acid and its derivatives provide, for example, fluorine compounds which can be converted by a wide range of synthetic methods into products of pharmacological interest, such as fluoropimelic acids, alkylfluorobarbituric acids or 5-fluorouracil.

Fluoromalonic acid and its derivatives can be prepared by various methods, which, however, generally give poor yields and in which moreover very toxic or expensive starting compounds are used. Thus, it is known that diethyl fluoromalonate can be obtained by reacting ethyl monofluoroacetate and ethyl chloroformate under basic conditions (J. Chem. Soc. 1959, 3286–3289), by halogen exchange between diethyl chloromalonate and potassium fluoride (USSR Patent 185,878 (1966)—cf. Chem. Abstr. 67, 2777 r (1967)) or by fluorination of diethyl malonate with perchloryl fluoride (J. Org. Chem. 31, 916–918 (1966)). Processes for the preparation of fluoromalonic acid derivatives by ammonolysis or alcoholysis of hexafluoropropene (Japanese Preliminary Published Application No. 59-046 256 (1984), Chem. Let. 1981, 107–110), five of the six fluorine substituents being eliminated, so that fluorides or hydrogen fluoride are or is inevitably obtained.

According to the prior art, there was therefore a need for providing a process for the preparation of fluoromalonic acid and its derivatives which does not start from toxic or expensive compounds, does not inevitably produce fluorides or hydrogen fluoride and permits the preparation of both fluoromalonic acid and its derivatives in high yields.

This object can now be achieved, according to the invention, by electrochemically dehalogenating halofluoromalonic acids, which are readily obtainable, for example, by selective hydrolysis of tetrahalo-2-fluoropropionic acids, or their derivatives, i.e. compounds of the formula I. This gives compounds of the formula II

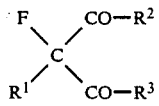

(I)

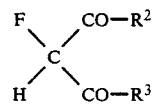

(II)

In formula I, $R^1$ is halogen having an atomic weight of from 35 to 127, i.e. chlorine, bromine or iodine, preferably chlorine. In formulae I and II, $R^2$ and $R^3$ are identical or different and denote hydroxyl or the group OX, wherein X represents an alkali metal ion, alkaline earth metal ion or $NH_4+$ ion, such as lithium, sodium, potassium, magnesium or calcium, or a $C_1$–$C_{12}$-alkyl radical, preferably $C_1$–$C_6$-alkyl radical, or $R^2$ and $R^3$ denote the group $NR^4R^5$, wherein $R^4$ and $R^5$ are identical or different, and hydrogen or a hydrocarbon radical having 1 to 12 carbon atoms. This hydrocarbon radical can be aromatic, cycloaliphatic or aliphatic and advantageously has 1 to 6 carbon atoms. For example, it represents phenyl. However, $R^4$ and $R^5$ are preferably hydrogen and/or $C_1$–$C_6$-alkyl.

Preferred radicals $R^2$ and $R^3$ are hydroxyl radicals and those radicals in which X represents an alkali metal ion or $NH_4+$ ion or an alkyl radical.

Suitable alkyl radicals for X, $R^4$ and $R^5$ are, in particular, methyl, ethyl and the various propyl, butyl, pentyl and hexyl radicals, but also higher radicals such as the various octyl, decyl and dodecyl radicals.

Thus, suitable starting compounds for the process according to the invention are chlorofluoromalonic acid, bromofluoromalonic acid and iodofluoromalonic acid and their esters, amides and salts which conform to formula I.

The process according to the invention can be carried out in divided or undivided electrolysis cells at a temperature of from −20° C. to the boiling point of the electrolyte at a current density of from 1 to 600 $mA/cm^2$, at a cathode consisting of lead, cadmium, zinc, copper, tin, zirconium, mercury, alloys of at least two of these metals or carbon in an electrolyte liquid, whose liquid medium consists of water and/or an organic solvent. For dividing the cells into the anode space and cathode space, the usual diaphragms which are stable in the electrolyte and consist of organic polymers, such as polyethylene, polypropylene, polyesters and polysulfones, in particular halogen-containing polymers, such as polyvinyl chloride or polyvinylidene fluoride, but preferably those consisting of perfluorinated polymers, or diaphragms consisting of inorganic materials, such as glass or ceramic, but preferably ion exchange membranes. Preferred ion exchange membranes are cation exchange membranes consisting of polymers, such as polystyrene, but preferably of perfluorinated polymers which contain carboxyl and/or sulfo groups. It is also possible to use stable anion exchange membranes.

According to the invention, cathodes which are stable in the electrolyte are used. Electrolysis can be carried out either continuously or batchwise and in all conventional electrolysis cells, such as, for example, in beaker cells or plate and frame cells or cells having fixed-bed or fluidized-bed electrodes. Either monopolar or bipolar connection of the electrodes are possible. A procedure in divided electrolysis cells (i.e. using a catholyte liquid and anolyte liquid) with batchwise operation of the cathode reaction and continuous operation of the anode reaction is particularly advantageous. The electrode materials used according to the invention have an average to high hydrogen overvoltage. Carbon cathodes are preferably used, particularly in electrolysis in acidic electrolytes having a pH of from 0 to 4, since some of the electrode materials mentioned, for example Zn, Sn, Cd and Pb, may suffer corrosion. In principle, all possible carbon electrode materials, such as electrode graphites, impregnated graphite materials, carbon felts and glassy carbon, are suitable as carbon cathodes.

All materials conventionally used in anode reactions can be employed as anode material. Examples are lead, lead dioxide on lead or other carriers, platinum, titanium dioxide and titanium, where the titanium dioxide is doped with noble metal oxides, for example ruthenium oxide, or other materials for the evolution of oxygen from dilute acids, such as sulfuric acid, phosphoric acid or tetrafluoboric acid.

Carbon, or titanium dioxide on titanium where the titanium dioxide is doped with noble metal oxides, or other materials for the evolution of chlorine from aqueous alkali metal chloride or hydrogen chloride solutions are also suitable.

Preferred anolyte liquids are aqueous mineral acids or solutions of their salts, such as dilute sulfuric acid, phosphoric acid, tetrafluoboric acid, concentrated hydrochloric acid, sodium sulfate solutions or sodium chloride solutions.

Examples of suitable organic solvents are short-chain aliphatic alcohols, such as methanol, ethanol, n-propanol and isopropanol or the various butanols, diols, such as methylene glycol, the various propanediols, and also polyalkylene glycols obtained from ethylene glycol and/or propylene glycol and their ethers, ethers, such as tetrahydrofuran or dioxane, amides, such as N,N-dimethylformamide, hexamethylphosphoric triamide, N-methyl-2-pyrrolidone, nitriles, such as acetonitrile or propionitrile, ketones, such as acetone, and other solvents, such as sulfolane or dimethyl sulfoxide. Mixtures can also be used. In principle, a two-phase electrolyte with the addition of a water-insoluble organic solvent, such as tert-butyl methyl ether or methylene chloride, in conjunction with a phase-transfer catalyst is also possible.

The amount of the organic solvents in the electrolyte in the undivided cell or in the catholyte in the divided cell can be 0 to 100% by weight, based on the total amount of the electrolyte or catholyte. It is preferably 10 to 80% by weight.

Soluble salts of metals having a hydrogen overvoltage of at least 0.25 V (based on a current density of 300 $mA/cm^2$) and/or dehalogenating properties can also be added to the electrolyte in the undivided cell or to the catholyte in the divided cell. Suitable salts are mainly the soluble salts of Cu, Ag, Au, Zn, Cd, Hg, Sn, Pb, Tl, Ti, Zr, Bi, V, Ta, Cr, Ce, Co or Ni, preferably the soluble Pb, Zn, Cd and Ag salts. The preferred anions of these salts are $Cl^-$, $SO_4^{--}$, $NO_3^-$ and $CH_3COO^-$. The salts can be added to the electrolyte solution or can be produced in the solution, for example by adding oxides, carbonates, etc. — in some cases also the metals themselves (where soluble). Their concentration in the electrolyte of the undivided cell and in the catholyte of the divided cell is advantageously adjusted to about $10^{-5}$ to 10% by weight, preferably to about $10^{-3}$ to 5% by weight, based in each case on the total amount of the electrolyte or catholyte.

The electrolysis can be carried out n a wide pH range, most advantageously at a pH of from 0 to 13, preferably from 0.5 to 12. To obtain this value and to increase the conductivity, inorganic or organic acids can be added to the catholyte when working in the divided cell or to the electrolyte when working in the undivided cell, preferably acids such as hydrochloric acid, boric acid, phosphoric acid, sulfuric acid or tetrafluoboric acid and/or formic acid, acetic acid or citric acid and/or their salts; when acids which form sparingly soluble compounds with the abovementioned metals in the neutral or basic range are used, the reaction is of course carried out only in pH ranges in which no insoluble compounds form.

The addition of organic bases may also be necessary for obtaining the pH advantageous for the electrolysis and/or for advantageously influencing the course of the electrolysis. Primary, secondary and tertiary $C_2$–$C_{12}$-alkyl- and cycloalkylamines, aromatic and aliphatic-aromatic (in particular araliphatic) amines and their salts, inorganic bases, such as alkali metal and alkaline earth metal hydroxides, such as, for example, Li hydroxide, Na hydroxide, K hydroxide, Cs hydroxide, Mg hydroxide, Ca hydroxide or Ba hydroxide, quaternary ammonium salts having anions such as, for example, the fluorides, chlorides, bromides, iodides, acetates, sulfates, hydrogensulfates, tetrafluoborates, phosphates and hydroxides, are suitable, combinations of cations and anions which lead to unsoluble products under the conditions used being, of course, unsuitable. Suitable ammonium salts are, for example, those of $C_1$–$C_{12}$-tetraalkylammonium, of $C_1$–$C_{12}$-trialkylarylammonium and of $C_1$–$C_{12}$-trialkylmonoalkylarylammonium. However, it is also possible to use anionic or cationic emulsifiers in amounts of from 0.01 to 15, preferably from 0.03 to 10%, by weight, based on the total amount of the electrolyte or catholyte.

In the electrolysis in an undivided cell, compounds which are oxidized at a more negative potential than the halogen ions liberated may be added to the electrolyte, in order to avoid the formation of the free halogen. For example, the salts of oxalic acid, of methoxyacetic acid, of glyoxylic acid, of formic acid and/or of hydrazoic acid are suitable for this purpose.

Electrolysis is preferably carried out at a current density of from 10 to 500 $mA/cm^2$. The electrolysis temperature is advantageously in the range from −10° C. to the boiling point of the electrolysis liquid, preferably from 5° to 90° C., in particular from 15° to 80° C.

The electrolysis product is worked up in a conventional manner, for example by extraction from the reaction medium or by distilling off the solvent. The compounds added to the catholyte can thus be recycled to the process.

For the preparation of fluoromalonates, the electrolysis is carried out in the corresponding alcohol. After the end of the electrolysis, the bulk of the alcohol is distilled off and the acid is esterified by conventional methods.

Unless otherwise stated, an electrolysis cell having the features below was used in the following examples. The yields are based on the conversion of chlorofluoromalonic acid.

Electrolysis cell

Jacketed glass pot cell having a volume of 350 ml; anode: platinum net (20 $cm^2$); cathode area: 12 $cm^2$; electrode spacing: 1.5 cm; anolyte: dilute aqueous sulfuric acid; cation exchange membrane; two-layer membrane consisting of a copolymer of perfluorosulfonylethoxyvinyl ether and tetrafluoroethylene (® Nafion 324 from E.I. du Pont de Nemours & Co., Wilmington, USA); mass transfer by means of a magnetic stirrer.

EXAMPLES (1) A catholyte consisting of 250 ml of water, 0.5 g of sodium hydroxide, 0.5 g of lead acetate and 10 g of chlorofluoromalonic acid was electrolyzed at a cathode consisting of impregnated graphite (®Diabon N from Sigri, Meitingen, Germany) at a current density of 88 mA/cm$^2$, a voltage of 7.2 to 5.8 V and a temperature of 30° C. The quantity of electricity consumed was 3.77 Ah and the pH was 0.8.

After the addition of NaCl solution to the catholyte, 7.36 g of fluoromalonic acid (yield 95.4%) and 0.114 g of unchanged chlorofluoromalonic acid were obtained by extracting with diethyl ether and distilling off the solvent.

(2) The arrangement differed in that a jacketed flow-through glass pot cell having a volume of 450 ml was used; the electrode spacing was 1 cm and mass transfer was effected with the aid of a pump having a delivery of 360 L/h. A catholyte consisting of 250 ml of water, 0.5 g of sodium hydroxide, 0.5 g of tetrabutylammonium hydrogensulfate and 2 g of chlorofluoromalonic acid was electrolyzed at a cathode consisting of lead sheet at a current density of 450 mA/cm$^2$, a voltage of 56 to 30 V and a temperature of 24 to 44° C. The quantity of electricity consumed was 0.754 Ah and the pH was 1.5 to 1.4.

After workup as in Example 1, 0.82 g of fluoromalonic acid (yield 96.8%) and 1.14 g of unchanged chlorofluoromalonic acid were obtained.

(3) A catholyte consisting of 300 ml of water, 0.5 g of sodium hydroxide, 0.5 g of silver nitrate and 4 g of chlorofluoromalonic acid was electrolyzed at a graphite electrode at a current density of 200 mA/cm$^2$, a voltage of 12 to 10.5 V and a temperature of 30° C. The quantity of electricity consumed was 1.78 Ah and the pH was 1.6.

After workup as in Example 1, 2.38 g of fluoromalonic acid (yield 90.9%) and 0.62 g of unchanged chlorofluoromalonic acid were obtained.

(4) The electrolysis cell differed in that there was no cation exchange membrane. An electrolyte consisting of 300 ml of water, 0.5 g of zinc chloride, 40 g of sodium formate and 6.8 g of chlorofluoromalonic acid was used and was electrolyzed at a cathode consisting of impregnated graphite (Diabon N) at a current density of 200 mA/cm$^2$, a voltage of 12.5 V and a temperature of 30° C. The quantity of electricity consumed was 3.03 Ah and the pH was 4.9.

For workup, the pH was adjusted to 1 with hydrochloric acid, and workup was carried out as in Example 1. 3.84 g of fluoromalonic acid (yield 96.9%) and 1.76 g of unchanged chlorofluoromalonic acid were obtained.

(5) A catholyte consisting of 300 ml of methanol, 0.5 g of lead acetate, 0.5 g of sodium hydroxide and 4 g of chlorofluoromalonic acid was used and was electrolyzed at a cathode consisting of impregnated graphite (Diabon N) at a current density of 200 mA/cm$^2$, a voltage of 30 to 17.5 V and a temperature of 30° C., at a pH of 1.04. After 1.78 Ah of electricity had been consumed, the bulk of the methanol was distilled off and the remaining solution was refluxed with p-toluenesulfonic acid. 3.98 g of dimethyl fluoromalonate (yield 84.5%) and 0.07 g of dimethyl chlorofluoromalonate were obtained.

(6) A catholyte consisting of 200 ml of 2 N NaOH solution in water and 10 g of chlorofluoromalonic acid was used and was electrolyzed at a cathode consisting of electrode graphite (type EH from Sigri, Meitingen, Germany) at a current density of 88 mA/cm$^2$, a voltage of 12 to 8 V and a temperature of 8° C., at a pH of 10.4. After 4.5 Ah of electricity had been consumed, the pH had fallen to 5.6. For workup, the pH was adjusted to 1 with hydrochloric acid, and workup was carried out as in Example 1. 6.94 g of fluoromalonic acid (yield 90%) were obtained.

(7) A catholyte consisting of 200 ml of isopropanol, 30 ml of 2 N hydrochloric acid, 2 g of methyltrioctylammonium chloride and 10 g of chlorofluormalonic acid was used and electrolyzed at a cathode consisting of impregnated graphite (Diabon N) at a current density of 88 mA/cm$^2$, a voltage of 16 to 12 V and a temperature of 30° C., at a pH of 0.9. After 5.1 Ah of electricity had been consumed, the bulk of the catholyte was distilled off and the remaining solution was saturated with hydrogen chloride gas and heated. 7.02 g of diisopropyl fluoromalonate (yield 46%) were obtained.

We claim:

1. A process for the preparation of fluoromalonic acid and derivatives thereof having the formula

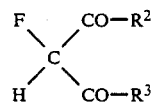

(II)

wherein $R^2$ and $R^3$ are equal or different and represent hydroxyl, the group OX, wherein X represents an alkali metal, alkaline earth metal or $NH_4^+$ion or a $C_1$-$C_{12}$-alkyl group, or represent the group $NR^4R^5$, wherein $R^4$ and $R^5$ are equal or different and are hydrogen or a hydrocarbon group of 1 to 12 carbon atoms, which comprises subjecting a compound of the formula

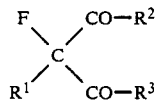

(I)

wherein $R^1$ is halogen of an atomic weight in the range from 35 to 127 and $R^2$ and $R^3$ have the meaning indicated above, to an electrolysis in an electrolyte liquid comprising water, an organic solvent or a mixture thereof, at a temperature in the range of from −20° C. to the boiling temperature of the electrolyte, at a current density in the range of from 1 to 600 mA/cm$^2$ at a cathode comprising lead, cadmium, zinc, copper, tin, zirconium, mercury, alloys of at least 2 of these metals or of carbon.

2. A process as claimed in claim 1, wherein the electrolysis is carried out at a pH in the range of from 0 to 13.

3. A process as claimed in claim 2, wherein the electrolysis is carried out at a pH in the range of from 0.5 to 12.

4. A process as claimed in claim 1, wherein the electrolysis is carried out at a carbon cathode at a pH in the range of from 0 to 4.

5. A process as claimed in claim 1, wherein the electrolysis is carried out at a temperature in the range of from 5 to 90° C.

6. A process as claimed in claim 5, wherein the electrolysis is carried out at a temperature in the range of from 15 to 80° C.

7. A process as claimed in claim 1, wherein the electrolysis is carried out at a current density in the range of from 10 to 500 mA/cm$^2$.

8. A process as claimed in claim 1, wherein the electrolysis is carried out in the presence of a soluble salt of a metal having a hydrogen excess voltage of at least 0.25V (referred to a current density of 300 mA/cm$^2$)

with an electrolyte in an undivided cell or with a catholyte in a divided cell, the concentration of the salt being in the range from $10^{-5}$ to 10% by weight, referred to the total amount of the electrolyte or catholyte.

9. A process as claimed in claim 8, wherein the salt is a salt of lead, zinc, cadmium or silver.

10. A process as claimed in claim 8, wherein the concentration of the salt is in the range of from $10^{-3}$ to 5% by weight.

11. A process as claimed in claim 9, wherein the concentration of the salt is in the range of from $10^{-3}$ to 5% by weight.

12. A process as claimed in claim 1, wherein the electrolysis is carried out in a divided electrolysis cell while conducting the reaction at the cathode in a discontinuous manner and the reaction at the anode in a continuous manner.

13. A process as claimed in claim 1, wherein the electrolyte in the undivided cell or the catholyte in a divided cell contains from 10 to 80% of organic solvent, referred to the total amount of the electrolyte or catholyte respectively.

14. A process as claimed in claim 1, wherein a compound of formula I is subjected to electrolysis, in which $R^1$ is chlorine.

15. A process as claimed in claim 1, wherein a compound is subjected to electrolysis, in which $R^2$ and $R^3$ each are equal or different $0C_1$–$C_6$-alkyl or hydroxyl.

16. A process for the preparation of fluoromalonic acid and derivatives thereof having the formula

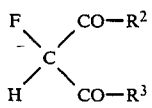

(II)

wherein $R_2$ and $R_3$ are equal or different and represent hydroxyl or the group $0C_1$–$C_6$-alkyl, which comprises subjecting a compound of the formula

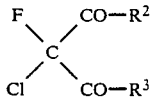

(III)

wherein $R^2$ and $R^3$ have the afore-mentioned meaning, at a pH in the range of from 0 to 4 at a temperature in the range of from 5° to 90° C. at a current density in the range of from 10 to 500 mA/cm$^2$ at a cathode comprising lead, cadmium, zinc, copper, tin, zirconium, mercury, alloys of at least 2 of these metals, or of carbon.

17. A process as claimed in claim 16, wherein the electrolysis is carried out in the presence of a soluble salt of a metal having a hydrogen excess voltage of at least 0.25 V (referred to a current density of 300 mA/cm$^2$) with an electrolyte in an undivided cell or with a catholyte in a divided cell, the concentration of the salt being in the range from $10^{-5}$ to 10% by weight, referred to the total amount of the electrolyte or catholyte.

18. A process as claimed in claim 17, wherein the salt is a salt of lead, zinc, cadmium or silver.

19. A process as claimed in claim 18, wherein the concentration of the salt is in the range of from $10^{-3}$ to 5% by weight.

20. A process for the preparation of fluoromalonic esters having the formula

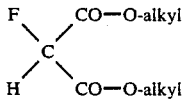

(IV)

wherein alkyl has 1 to 6 carbon atoms, which comprises subjecting a compound of the formula

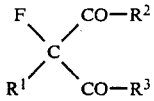

(I)

wherein $R^1$ is halogen of an atomic weight in the range from 35 to 127 and $R^2$ and $R^3$ are equal or different and represent hydroxyl, the group OX, wherein X represents an alkali metal, alkaline earth metal or $NH_4+$ ion or a $C_1$–$C_6$-alkyl group to an electrolysis in an electrolyte liquid comprising a monohydric alcohol at a temperature in the range of from −20° C. to the boiling temperature of the electrolyte, at a current density in the range of from 1 to 600 mA/cm$^2$ at a cathode comprising lead, cadmium, zinc, copper, tin, zirconium, mercury, alloys of at least 2 of these metals or of carbon.

21. A process as claimed in claim 20, wherein a compound of formula I is subjected to electrolysis, in which $R^1$ is chlorine.

22. A process as claimed in claim 21, wherein alkyl has from 1 to 3 carbon atoms.

23. A process as claimed in claim 20, wherein the electrolysis is carried out at a pH in the range of from 0 to 4.

* * * * *